US005160421A

United States Patent [19]

Melnyk et al.

[11] Patent Number: 5,160,421

[45] Date of Patent: Nov. 3, 1992

[54] ELECTROFORMS WITH HIGH DIMENSIONAL STABILITY

[75] Inventors: Andrew R. Melnyk, Rochester; William G. Herbert, Williamson, both of N.Y.; Henry Grey, Las Vegas, Nev.

[73] Assignee: Xerox Corporation, Stamford, Conn.

[21] Appl. No.: 801,206

[22] Filed: Dec. 2, 1991

[51] Int. Cl.[5] ..... C25D 1/00

[52] U.S. Cl. ..... 205/67; 205/69

[58] Field of Search ..... 205/67, 69

[56] References Cited

U.S. PATENT DOCUMENTS 3,464,898 5/1966 Norris ..... 204/4
4,473,516 9/1984 Hunerburg ..... 264/45.1
4,478,769 10/1984 Pricone et al. ..... 264/1.6
4,501,646 2/1985 Herbert ..... 204/4
4,627,894 12/1986 Monnier ..... 204/4
4,664,758 5/1987 Grey ..... 204/3
4,781,799 11/1988 Herbert, Jr. et al. ..... 204/4

*Primary Examiner*—T. M. Tufariello
*Attorney, Agent, or Firm*—Oliff & Berridge

[57] ABSTRACT

An electroforming process is used to prepare an electroformed metal layer on the inside surface of a female mandrel to form an electroform with a hollow interior. A device may be positioned within the hollow interior of the electroform, and the interior is filled with a filling material. The electroform may then be separated from the mandrel by a force applied to the device positioned within the filling material.

18 Claims, 4 Drawing Sheets

ELECTROFORMS WITH HIGH DIMENSIONAL STABILITY

This invention is directed to a process of producing electroforms with high dimensional stability, and metal objects formed thereby.

BACKGROUND

Metal objects used in machinery and equipment are often required to be manufactured to narrow dimensional tolerance and with high dimensional stability. However, it is often difficult to produce very large metal objects, such as, for example, a cylinder, to a high degree of dimensional stability, when the cross-sectional dimension of the cylinder is increased. This problem becomes increasingly worse as the thickness of the cylinder wall becomes thinner. In particular, handling the cylinder during manufacture is very difficult because such handling during processing and/or storage often causes defects.

One method of dealing with this problem is to form an electroform by an electroforming process on a mandrel, remove the electroform from the mandrel and then fill the electroform with a filling material such as foam. Unfortunately, however, as one increases the cross-sectional dimension of the electroform and/or the complexity of the circumference, one must increase the thickness of the electroform and support it during the foam filling operation, or the desired dimensional characteristics may be lost. This, however, increases the material cost, the processing time, the weight, and may require an additional processing step.

U.S. Pat. No. 4,473,516 to Hunerberg discloses a method and apparatus for injecting molded plastic articles having a solid outer surface and porous interior core with a molten mixture of chemically reactive foaming agent and a thermoplastic resin. The mold cavity is filled with the plastic mixture and subsequently an activator additive is introduced into the mixture which reacts with the foaming agent and facilitates cellular expansion within the core of the molded article. The result is a molded body with a solid unfoamed skin which accurately replicates the surface of the mold and a cellular inner core.

U.S. Pat. No. 4,627,894 to Monnier discloses a method of manufacturing a molded plastic body which is covered on its exterior with a metal layer. A metallic layer is deposited on the inner surface of a mold by an electrolytic method before the plastic material is introduced. A thermoplastic or thermosetting material is then introduced into the mold. After hardening of the plastic, the material removal from the mold is effected by applying thermal treatment.

U.S. Pat. No. 3,464,898 to Norris discloses an electroforming process for forming complex hollow metal articles in which a conductive material is deposited on the surface of a fine porosity plastic mandrel and a layer of metal is electrodeposited onto the conductive material in an electroforming bath. Finally, separation of the mandrel from the metal article, for example by use of a solvent or volatilization of the plastic mandrel, produces a metal article which is easily shaped and which maintains dimensional accuracy.

U.S. Pat. No. 4,781,799 to Herbert, Jr. et al. discloses an electroforming apparatus and process of forming electroformed articles which consists of an elongated electroform mandrel having two mating ends (segments) which can mate with each other during the electroforming process and which each have a circumferential, electrically conductive electroforming surface. During the electroforming process, electroforming a metal layer on the electroforming surface of each segment establishes a gap between each metal layer and the underlying segment. Subsequently, the removal of each metal layer from the underlying segment by sliding the metal layer axially along the underlying segment in which the end of the metal layer adjacent to the mating end of the underlying segment produces an article having a smooth round outer edge and improved dimensional requirements.

U.S. Pat. No. 4,664,758 to Grey discloses an electroforming process which incorporates an elongated electroforming mandrel core, applying a uniform coating of a molten, inert, inorganic, homogeneous electrically conductive metal or metal alloy to the mandrel core (the metal having a melting point and surface tension less than that of the mandrel core) and immersing the mandrel/metal composite in an electroforming bath. Next, an electroformed metal layer having a melting point greater than the metal or metal alloy is deposited on the coating and the coating is melted. Finally, the electroformed metal layer is removed from the mandrel core producing an electroformed article having the required dimensions and surface characteristics.

SUMMARY OF THE INVENTION

It is an object of the invention to provide an electroformed article with narrow dimensional tolerance and high dimensional stability.

It is a further object of the invention to provide an electroformed article which will maintain its structural stability during formation.

It is another object of the invention to provide a process for preparing an electroformed article with high tolerance and dimensional stability.

These objects and others are achieved by a process wherein a layer of metal is electroformed on the inside surface of a hollow mandrel to form an electroform having a hollow interior, filling the hollow interior with a filling material to form a composite body, optionally after inserting a device in the composite body, and separating the composite body from the mandrel. The device may assist with separating the composite body from the mandrel and may also function in the subsequent use of the composite body. At least a portion of the filling material may then be removed from the composite body if desired. A complex outer surface may be maintained on the electroform, and in particular on a very thin electroform, which is particularly useful for such devices as printing rollers.

DETAILED DESCRIPTION OF PREFERRED EMBODIMENTS

According to the invention, a metal layer is electroformed on the inside surface of a female mandrel, thereby forming an electroform with a hollow interior. The hollow interior is filled with a filling material to form a composite body which is then separated from the mandrel. The filling material may then optionally be partly or completely removed from the center of the composite body. In a preferred embodiment, a device such as a shaft which may be used with a gear, bearing, handle, door knob, hook-and-eye or other latching arrangement and the like is placed in the hollow interior of the electroformed layer before it is filled with the filling material. After filling, this device may become an integral part of the composite body, or may simply be used to assist in removing the composite body from the mandrel and/or in removing the filling material from the electroform.

Figure 1:
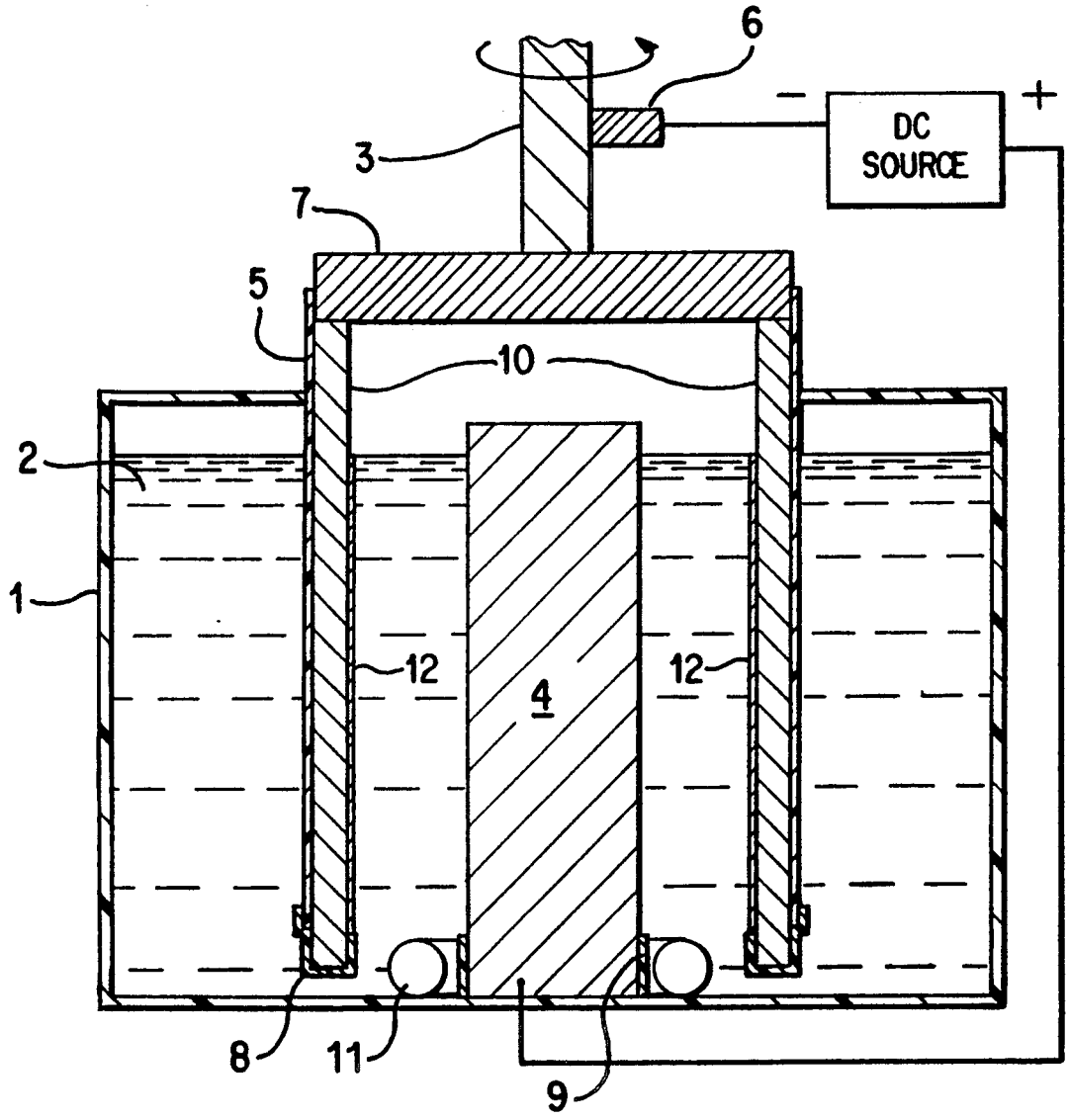
FIG. 1 depicts electroforming apparatus which may be used in accordance with the invention.

The electroforming process which can be used to form the electroformed article is may employ an apparatus as shown in FIG. 1.

In FIG. 1, an electrolytic cell for plating on the inside of a mandrel is shown, which contains a tank 1 which holds an electroforming bath 2. The tank is constructed of and/or lined with materials which are compatible with the electroforming bath and operating conditions. A drive mechanism is attached to the electrolytic cell by means of a rotating support and contact 3, which is attached to a mandrel hanger 7 and acts as a conductor of electricity between contact brushes 6 and the mandrel hanger 7. The mandrel hanger 7 connects the drive mechanism to the mandrel 10 and conducts electricity to the mandrel. The anode system 4 of the electrolytic cell is comprised of a basket to contain the anodes, an anode bag, anodes, and a solution return system. The basket is typically titanium. The anode bag is typically nap polyolefin. The solution return system is constructed of PVC or PVDC. High density anodes (i.e., such as carbonyl) are preferred because they provide a relatively higher surface area.

An outside mandrel covering 5 is coated on the outside of the mandrel 10 to block deposition, and is made of any nonconductive material which is not attacked by the eleotrolyte. The outside mandrel covering 5 is typically formed from materials such as wax, Plastisol®, Microshield®, etc. Contact brushes 6 allow the transfer of electricity from the power source to the rotating member 3. Typically, the contact brushes 6 are spring-loaded copper filled carbon brushes. At the bottom of the mandrel is located a mandrel mask 8 which prevents electrodeposition on the bottom of the mandrel 10 and may be removed to facilitate removal of the electroform 12. An anode mask 9 is found at the bottom of the anode system 4. It is constructed of a nonconducting material, such as PVC, and limits the current path at the bottom of the electrolytic cell. It thus facilitates a more uniform deposit thickness of the electroform 12. The anode mask 9 may serve as an anode basket stand. The mandrel core may be formed from aluminum, zinc, lead, cadmium or stainless steel; preferably the mandrel core is zinc. A solution input manifold 11 permits electroforming bath solution to be pumped into the cell between the anode and the cathode and assures good distribution of the electroforming bath. Spargers (not shown) may also be used to facilitate good solution flow of the electroforming bath. Solution return should be, at least in part, through the anode system (not shown). The balance of the solution is returned via overflowing a wire which will keep the solution surface free of floating material and at a constant level.

Suitable electroforming baths for use in practicing this invention can be prepared by those of ordinary skill in the art. An electroforming bath for use with the above apparatus may be formed of the following materials:

MAJOR ELECTROLYTE CONSTITUENTS

Nickel Sulfamate—as $Ni+^2$, 8-12 oz/gal. (60-90 g/L)

Chloride—as $NiCl_2 \cdot 6H_2O$, 1-7 oz/gal. (7.5-52.5 g/L)

Boric Acid—5.0-5.4 oz/gal. (37.5-40.5 g/L)

pH—3.85-4.05 at 23° C.

Surface Tension—at 136° F., 32-37 d/cm using sodium lauryl sulfate (about 0.00525 g/l)

Saccharin—0-2 mg/L, as sodium benzosulfimide dihydrate

Leveler—0-70 mg/L as 2-butyne 1,4-diol

IMPURITIES

Aluminum—0-20 mg/L

Ammonia—0-400 mg/L

Arsenic—0-10 mg/L

Azodisulfonate—0-50 mg/L

Cadmium—0-10 mg/L

Calcium—0-20 mg/L

Hexavalent Chromium—4 mg/L maximum

Copper—0-25 mg/L

Iron—0-250 mg/L

Lead—0-8 mg/L

MBSA—(2-methyl benzene sulfonamide)—0-2 mg/L

Nitrate—0-10 mg/L

Organics—(Concentration depends on the type; however, all known types need to be minimized.)

Phosphates—0-10 mg/L

Silicates—0-10 mg/L

Sodium—0-0.5 g/L

Sulfate—0-2.5 g/L

Zinc—0-5 mg/L

OPERATING PARAMETERS

Agitation Rate—4-6 Linear ft/sec solution flow over the cathode surface

Cathode (Mandrel)—Current Density, 100-400 ASF (amps per square foot)

Ramp Rise—0 to operating amps in 0 to 5 min. ±2 sec.

Plating Temperature at Equilibrium—130°-155° F.

Anode—Electrolytic, Depolarized, or Carbonyl Nickel

Anode to Cathode Ratio—0.75:1 minimum

Mandrel Core—Aluminum, Zinc, Lead, Cadmium or Stainless Steel

In a preferred embodiment, an electroforming bath is comprised of the following materials: 11.5 oz/gal nickel sulfamate, 2.5 oz/gal chloride, and 5 oz/gal boric acid. The pH is maintained at 3.95, surface tension at 35 d/cm, and leveler as required up to 70 mg/L. The agitation rate is 6 linear ft/sec. The cathode current density is 250 ASF. The ramp rise is 1 minute. The plating temperature at equilibrium is 140° F. The anode is made of carbonyl nickel. The anode to cathode ratio is 0.9 to 1. The mandrel core is zinc.

The electroforming bath which is used with a female mandrel is substantially different from that used with a male mandrel in two significant ways. First, the electroforming bath is operated in such a manner that the deposit is slightly compressive; this ensures that the electroform will not buckle and will "push" against the mandrel during deposition, thereby staying in place. Thus, stress reducers such as saccharin and MBSA are kept to a minimum to produce the compressive deposit. Second, because the anode is located on the inside of the female mandrel (in contrast to the anode being positioned on the outside of the male mandrel), the desired 2:1 anode to cathode ratio can not be obtained. Consequently, in the electrolytic cell used in the process of the invention, the anode is made as large as possible while still maintaining clearance between the anode and the mandrel and good solution flow of the electroforming bath in this area of the electrolytic cell.

Any suitable metal capable of being deposited by electroforming and having a coefficient of expansion between $6\times10^{-6}$ in./in./°F. and about $10\times10^{-6}$ in./in./°F. may be used in the process of this invention. The use of a female mandrel permits the use of a wide range of metals. Typical metals that may be electroformed include nickel, copper, cobalt, iron, silver, gold, lead, zinc, aluminum, tin, rubidium, rhenium, palladium, and the like, and alloys thereof, such as brass and bronze. When such metals are employed, the separation of the composite body from the mandrel can be effected by heating the mandrel or cooling the composite body. Electroforming under conditions that impart tensile stress to the electroform can also assist in separation. Removal is further facilitated by the presence of the device which may serve as a handle for removing the composite body from the mandrel.

In this embodiment, an electroformed cylinder is prepared on a female mandrel 10, with the metal electroform 12 being deposited on the interior surface of the mandrel. This manner of deposition is particularly advantageous for the preparation of cylinders on which a particular design or surface treatment is desired on the external surface of the electroform. Such a design can be installed on the interior surface of the female mandrel prior to electroforming; the electroform 12 will replicate this design or surface treatment. The production of such electroformed cylinders is particularly useful for such applications as preparing printing rollers for applying designs/print on wallpaper, fabric, paper, plastic or the like. In particular, in xerography, the electroformed cylinders of the invention may be employed to eliminate print defects such as, for example, "plywooding" wherein a print defect resembling plywood is formed in imaging members. The electroformed cylinders of the invention may also be used to produce uniform surfaces in a matte, bright, or semi-bright finish.

Electroforming current may be supplied to the tank from a suitable DC source. The positive end of the DC source may be connected to the anode basket and the negative end of the DC source connected to the drive mechanism which is attached to the rotating support and drives the mandrel. The electroforming current passes from the DC source connected to the anode basket, to the plating solution, the mandrel, the drive mechanism, and back to the DC source.

In operation, the female mandrel 10 is lowered into the electroforming tank 1, and is preferably continuously rotated. As the female mandrel rotates, a layer of electroformed metal 12 is deposited on its inner surface. The electroform is preferably thin, because this is most cost effective, provides an electroform with less mass, permits the anodes to last longer, requires less bath maintenance, generates less heat and ensures better bath stability, particularly for electroforms with large surface area. The thickness of the electroform 12 will vary, depending on the time and current density (i.e., coulombs, amp/sec) applied. The thickness needed will depend on the use for which the electroform is intended. For example, if a ground plane is needed for a xerographic device, then 0.00001 inches is more than enough. If a device which will be subjected to wear is being produced, a 0.001 inch thickness is preferred.

Figure 2:
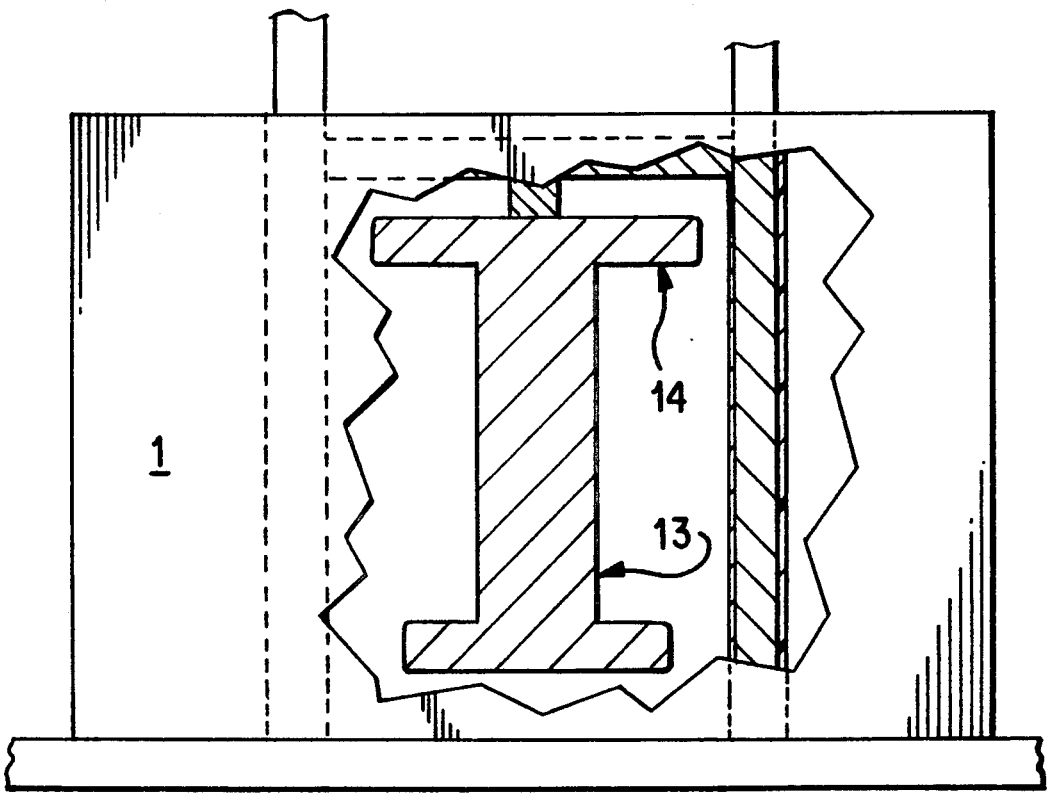
FIG. 2 depicts the step of positioning a device within an electroform on a mandrel according to the invention.

After the completion of the electroforming process, the electroform is removed from the electroforming bath 1 and rinsed. A device such as, for example, a drive shaft 13 may be positioned inside the cavity of the female mandrel. See FIG. 2. This device 13 may be used simply to assist with the removal of the electroformed cylinder after it is completed, or may constitute an integral part of a final composite body. Preferably, the device is rod-shaped, and has protuberances 14 which increase the surface area to which the foam is exposed, and thus provide sufficient adhesion to hold the filling material when removing the electroform 12 from the mandrel 10.

Figure 3:
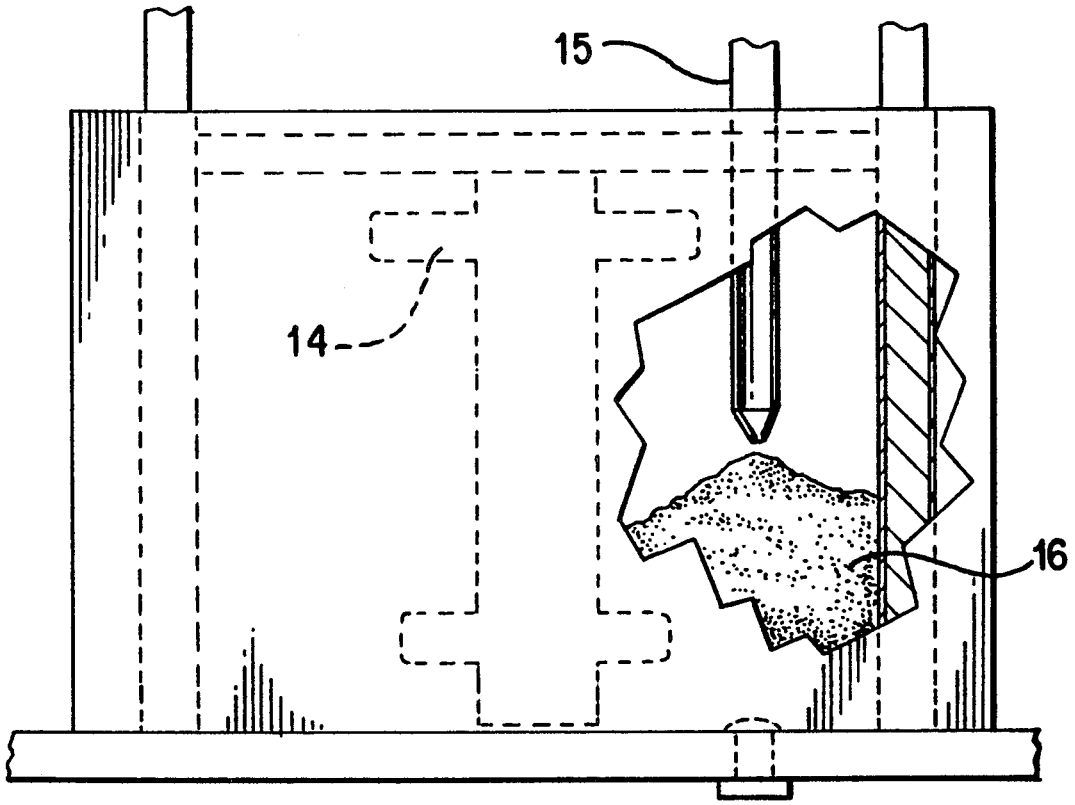
FIG. 3 depicts the step of inserting filling material into the electroform while it is still on the mandrel and after the device has been positioned.

After the electroforming is completed and the device has been positioned, an instrument such as injection nozzle 15 for inserting filling material 16 into the cavity of the electroform 12 is then placed within the cavity in the space between the device and the electroform. See FIG. 3. The electroform 12 is then filled with filling material 16 in such a manner that the electroform is not moved or repositioned. The filling continues until the entire interior surface of the electroform is in contact with the filling material. The entire volume within the electroform is thus filled with the filling material and the electroform is supported thereby. The instrument 15 is preferably removed as the filling material fills the interior volume of the electroform.

Filling materials which are useful for this invention include foams such as closed-cell polyurethane, polystyrene, foam rubber, melted paraffin and air, beeswax and air, and even such materials as cement, wood chips and the like. The filling material may be selected to be advantageous for creating a desired parting gap. For example, some foam expands initially but then shrinks slightly as it sets. With this type of foam, a more tensile electroform deposit is useful, provided sufficient adhesion is present in the initial deposit.

The filling material 16 may remain an integral part of the electroformed object. The filling material may be rigid or have elastomeric properties which permit the electroform composite body to be flexible. If it is desired that the filling material be removed from the electroform 12 before its use, a particularly advantageous filling material is one which is soluble in organic solvents or water. It can be easily removed after the electroform has been removed from the mandrel by being dissolved in the solvent.

Figure 4:
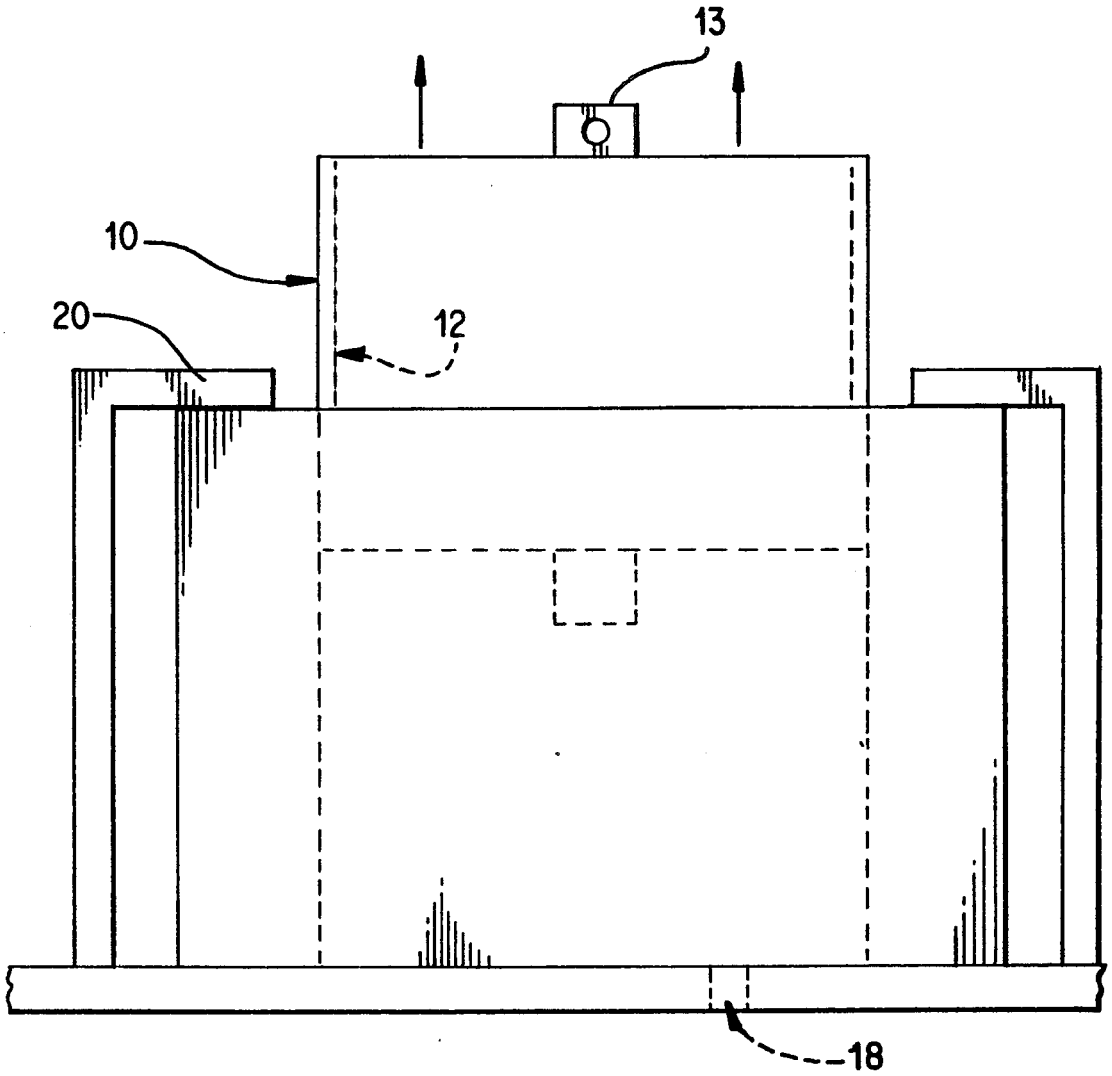
FIG. 4 depicts the step of separating the composite body from the mandrel.

When the electroforming and filling are both performed in the electroforming tank, the entire composite formed by the device, the filling material and the electroformed cylinder may be removed from the electroforming tank. See FIG. 4. The device 13 is lifted upward by an external force. Air plug 18 permits air to enter the space occupied by the device, thereby facilitating the removal of the device 13 from the mandrel 10.

The electroform 12, which adheres to the filling material 16 into which the device 13 has been positioned, is thereby removed from the mandrel in a manner which preserves the dimensions to which the electroform was formed during the electroforming process. A clamp 20 assists in stabilizing the tank containing the mandrel during the removal process. The removal of the electroform can be facilitated by either heating the mandrel or cooling the electroform. If the temperature is manipulated to achieve a parting gap, it is not necessary to produce a large parting gap, because the device serves as a handle to assist with the removal process.

After removal of the filling material/electroform composite from the mandrel, the device may or may not be removed from the composite, and the filling material may or may not be removed from the electroform, depending on the intended use of the electroform. The removal of the filling material may be accomplished by such methods as dissolving the filling material in a solvent, melting the filling material, or physically removing the filling material by grinding or other machining methods. Either a single method or a combination of the above methods may be used to effect the removal of the filling material.

A particular advantage of the process of this invention is the broad range of applications enabled by a device/filling material/electroform composite. For example, where an electroform is prepared for use in a printing machine for printing a design on a large number of units of a material such as, for example, paper or cloth, this process enables the design to be prepared on the electroform which is then permanently filled and reinforced with a durable plastic material, and a mechanical device inserted within the plastic material which is capable of attaching the composite to the printing machine as an integral unit.

In another embodiment, where an electroform is prepared for use as a conduit of, for example, wires or fibers, wherein a highly precise outer diameter of protective metal and a highly precise inner diameter of plastic, insulating inner coating are required, this process enables the high precision to be achieved by preparing the electroform to the required dimensions, by inserting a device according to the required dimensions for the inner diameter of the conduit, by filling the electroform with a flexible, durable plastic material to fill the space between the electroform and a device, and by removing the device after completion of the process to create the space bounded by the inner diameter for carrying the wires or fibers.

In a further embodiment, where an electroform is required to be prepared to highly precise dimensions for use as, for example, a transmission belt in a high precision machine, this process enables the electroform to be prepared to the desired highly precise dimensions, the electroform to be filled with a solid, soluble filling material and a device for assisting with the removal of the electroform to be inserted into the filling material. After removal of the electroform from the mandrel, the filling material may be dissolved and the device removed, and the electroform placed within the transmission for use as a flexible, continuous metal member.

For applications in a xerographic machine, the electroform of the invention is particularly useful where an electroform may be required to be rigid, such as in a substrate for a photoreceptor, compliant, such as in a donor roll, or semi-compliant, such as in a fuser role.

This invention will further be illustrated in the following non-limiting examples, it being understood that these examples are intended to be illustrative only, and that the invention is not intended to be limited to the materials, conditions, process parameters and the like recited therein.

EXAMPLE 1

A photoreceptor substrate is prepared in the following manner. 0.00005 inches of electroformed nickel is deposited on a mandrel to produce a matte finish having a RMS of 8μ inch. The nickel electroform is removed from the electroforming bath, is rinsed with hot (70° C.) deionized water (100,000 ohms or greater), and permitted to air dry. After drying, a drive shaft with a gear attached to one end is centered within the electroform. The mandrel is then filled completely with closed-cell polyurethane to form a composite of drive shaft and polyurethane. The composite is separated from the mandrel and subsequently spray-coated with photoconductor layers. A photoreceptor substrate formed in this manner will not have any "plywood" surface defect.

EXAMPLE 2

A donor roll is prepared in the same manner as Example 1, with the exception that the nickel electroform is prepared to a thickness of 0.0005 inch. After air drying, a drive shaft with a gear attached to one end is centered in middle of the electroform, and is then filled with a compliant foam rubber. The composite is then separated from the mandrel. No spray-coating is required.

Other modifications of the present invention may occur to those skilled in the art subsequent to a review of the present application, and these modifications, including equivalents thereof, are intended to be included within the scope of the present invention.

What is claimed is:

1. A process of preparing an electroform, comprising the steps of:

electroforming a layer of metal on an inner surface of a hollow mandrel, said mandrel being submerged in an electroforming bath, thereby forming an electroform having a hollow interior;

filling said hollow interior with a filling material before removing said electroform from said mandrel;

removing said electroform and said filling material from said mandrel; and removing at least part of said filling material from said electroform.

2. The process of claim 1, wherein said filling material is selected from the group consisting of closed-cell polyurethane, polystyrene, foam rubber, melted paraffin, and beeswax.

3. The process of claim 1, wherein said filling material comprises foamed plastic.

4. The process of claim 1, wherein said mandrel is substantially cylindrical.

5. The process of claim 1, wherein said inner surface bears a pattern which is formed in said electroform.

6. The process of claim 1, wherein said electroform and said filling material comprise a printing roller.

7. A process of preparing an electroform, comprising the steps of:

electroforming a layer of metal on an inner surface of a hollow mandrel, said mandrel being submerged in an electroforming bath, thereby forming an electroform having a hollow interior;

positioning a device within the hollow interior of the cylinder;

filling said hollow interior with a filling material; and removing said electroform and said filling material from said mandrel.

8. The process of claim 7, further comprising the step of applying force to said device to remove said electroform with said filling material from said mandrel.

9. The process of claim 7, wherein said device is a drive shaft.

10. The process of claim 7, wherein said mandrel is substantially cylindrical.

11. The process of claim 7, wherein said inner surface bears a pattern which is formed in said electroform.

12. The process of claim 7, wherein said electroform with said filling material and device comprises a printing roller.

13. An electroform prepared by a process comprising the steps of:

electroforming a layer of metal on the inner surface of a hollow mandrel, thereby forming an electroform with a hollow interior;

filling said hollow interior with a filling material before removing said electroform from said mandrel; and removing said electroform and said filling material from said mandrel; and removing said filling material from said electroform.

14. The electroform of claim 13, wherein said filling material is selected from the group consisting of closed-cell polyurethane, polystyrene, foam rubber, melted paraffin, and beeswax.

15. The electroform of claim 13, wherein said filling material comprises foamed plastic.

16. An electroform prepared by a process comprising the steps of:

electroforming a layer of metal on an inner surface of a hollow mandrel, thereby forming an electroform with a hollow interior;

positioning a device within the hollow interior of the electroform;

filling said hollow interior with a filling material; and removing said electroform and said filling material from said mandrel.

17. The electroform of claim 16, wherein said process further comprises the step of applying force to said device to remove said electroform with said filling material from said mandrel.

18. The electroform of claim 16, wherein said device is a drive shaft.

* * * * *